US010968904B2

(12) United States Patent
Hilgers et al.

(10) Patent No.: US 10,968,904 B2
(45) Date of Patent: Apr. 6, 2021

(54) TANDEM MOTOR LINEAR ROD PUMP

(71) Applicant: Unico, LLC, Franksville, WI (US)

(72) Inventors: Andrew J. Hilgers, Franklin, WI (US); Michael A. MacDonald, Racine, WI (US); Benjamin J. Gregory, Racine, WI (US); Ronald G. Peterson, Racine, WI (US)

(73) Assignee: Unico, LLC, Franksville, WI (US)

( * ) Notice: Subject to any disclaimer, the term of this patent is extended or adjusted under 35 U.S.C. 154(b) by 93 days.

(21) Appl. No.: 16/230,376

(22) Filed: Dec. 21, 2018

(65) Prior Publication Data

US 2019/0120218 A1 Apr. 25, 2019

Related U.S. Application Data

(62) Division of application No. 15/283,934, filed on Oct. 3, 2016, now Pat. No. 10,197,048.

(Continued)

(51) Int. Cl.
*F04B 19/22* (2006.01)
*F04B 53/10* (2006.01)

(Continued)

(52) U.S. Cl.
CPC ..... *F04B 19/22* (2013.01); *E21B 43/127* (2013.01); *F04B 9/02* (2013.01); *F04B 9/047* (2013.01);

(Continued)

(58) Field of Classification Search
CPC ..... F04B 47/02; F04B 53/12; F04B 53/128; F04B 53/129; F04B 19/22; F04B 53/1032;

(Continued)

(56) References Cited

U.S. PATENT DOCUMENTS 3,554,097 A 1/1971 Karpowicz
3,583,426 A * 6/1971 Feres ..... B67C 3/28 137/240

(Continued)

FOREIGN PATENT DOCUMENTS

CN 201621047 U 11/2010
CN 102606088 7/2012

(Continued)

OTHER PUBLICATIONS

Supplementary European Search Report for corresponding European Patent Application No. 15856188.4, dated Oct. 24, 2018, 1 page.

*Primary Examiner* — Charles G Freay
*Assistant Examiner* — David N Brandt
(74) *Attorney, Agent, or Firm* — Reinhart Boerner Van Deuren P.C.

(57) ABSTRACT

An oil pumping system to carry oil from an oil sump in a pump housing to an internal oil reservoir in another portion of the pump housing. A top plate is attached to a pump rod and moves in accordance with a reciprocating motion of the pump rod. A bottom plate is below the top plate. A pump mechanism, disposed between the top plate and bottom plate, includes a valve seat that contacts the bottom plate, and an upper portion that contacts the top plate. A first biasing element is configured to urge the valve seat upward away from the bottom plate. A second biasing element is configured to urge the plunger upward away from the valve seat. Upward movement of the pump rod allows oil to flow into the pump mechanism. Downward movement of the pump rod causes the bottom of the valve seat to seal against the bottom plate.

6 Claims, 12 Drawing Sheets

Related U.S. Application Data

(60) Provisional application No. 62/241,428, filed on Oct. 14, 2015.

(51) Int. Cl.

| | |
|---|---|
| ***F04B 9/02*** | (2006.01) |
| ***F04B 53/14*** | (2006.01) |
| ***E21B 43/12*** | (2006.01) |
| ***F04B 47/02*** | (2006.01) |
| ***F04B 49/06*** | (2006.01) |
| ***F04B 17/03*** | (2006.01) |
| ***F04B 51/00*** | (2006.01) |
| ***F04B 53/20*** | (2006.01) |
| ***F04B 9/04*** | (2006.01) |

(52) U.S. Cl.
CPC ..... *F04B 17/03* (2013.01); *F04B 47/02* (2013.01); *F04B 47/022* (2013.01); *F04B 49/06* (2013.01); *F04B 49/065* (2013.01); *F04B 51/00* (2013.01); *F04B 53/10* (2013.01); *F04B 53/1032* (2013.01); *F04B 53/1087* (2013.01); *F04B 53/14* (2013.01); *F04B 53/20* (2013.01)

(58) Field of Classification Search
CPC ..... F04B 53/10; F04B 9/02; F04B 53/1087; F04B 53/14; F16K 31/54; F16K 25/00; E21B 43/36; E21B 43/38; E21B 43/385; E21B 43/40; F01M 5/005; F01M 2005/008; F01M 11/04
See application file for complete search history.

(56) References Cited

U.S. PATENT DOCUMENTS

| | | | | |
|---|---|---|---|---|
| 3,646,969 | A * | 3/1972 | Stampfli | F16K 11/048 137/627.5 |
| 5,836,205 | A | 11/1998 | Meyer | |
| 5,836,746 | A | 11/1998 | Maruyama et al. | |
| 7,168,924 | B2 | 1/2007 | Beck et al. | |
| 8,152,492 | B2 | 4/2012 | Beck et al. | |
| 8,328,536 | B2 | 12/2012 | Beck | |
| 8,641,390 | B2 | 2/2014 | Beck et al. | |
| 8,708,671 | B2 | 4/2014 | Gregory | |
| 2007/0286750 | A1 * | 12/2007 | Beck | F04B 47/04 417/415 |
| 2011/0103974 | A1 | 5/2011 | Lamascus et al. | |
| 2011/0300003 | A1 * | 12/2011 | Hofstatter | E21B 43/127 417/53 |
| 2012/0230841 | A1 | 9/2012 | Gregory | |
| 2015/0233368 | A1 | 8/2015 | Gallaway | |

FOREIGN PATENT DOCUMENTS

| | | | |
|---|---|---|---|
| CN | 102606088 | A | 7/2012 |
| CN | 102828725 | A | 12/2012 |
| WO | 9924691 | A1 | 5/1999 |

* cited by examiner

TANDEM MOTOR LINEAR ROD PUMP

CROSS-REFERENCE TO RELATED PATENT APPLICATIONS

This patent application is a divisional of co-pending U.S. patent application Ser. No. 15/283,934, filed Oct. 3, 2016, which claims the benefit of U.S. Provisional Patent Application No. 62/241,428, filed Oct. 14, 2015, the entire teachings and disclosures of which are incorporated herein by reference thereto.

FIELD OF THE INVENTION

This invention generally relates to systems and methods for the pumping of fluids, such as water and/or hydrocarbons, from subterranean formations or reservoirs, and more particularly to a pumping apparatus and method for use in such pumping applications.

BACKGROUND OF THE INVENTION

In many conventional types of pumping systems used in a drilling apparatus, controlling and optimizing the performance of a sucker-rod pumping apparatus involves inherent difficulties. One factor which must be taken into account is the stretching of the rod string, which occurs during the upward portion of each pump stroke, and the corresponding contraction of the rod string which occurs during the downward portion of each pump stroke. The rod string, which may be 1000 feet or more long, acts much like an extension spring, which is stretched during the portion of the pump stroke in which the rod string is drawing the fluid upward within the well, and which then contracts back to an essentially un-stretched state as the rod string moves downward during a return portion of the pump stroke. As a result of the rod stretch, an above-ground upward stroke of 32 inches, for a well approximately 1300 feet deep, may only result in a down-hole stroke in the range of 24 to 26 inches, for example. The difference between the magnitude and direction of movement of the pump rod at the top of the well and the corresponding reaction of the rod string and down-hole stroke of the pump involves other complicating factors, including inherent damping within the rod string, fluid damping which occurs during the pump stroke and longitudinal vibrations and natural frequencies of the rod string.

The problems associated with effectively and efficiently operating a sucker-rod pump apparatus are addressed in significantly greater detail in a commonly assigned U.S. Pat. No. 7,168,924 B2, to Beck et al., titled "Rod Pump Control System Including Parameter Estimator", the entire teachings and disclosure of which is incorporated herein by reference thereto. The Beck et al. patent also discloses a rod pump control system, which includes a parameter estimator that determines, from motor data, parameters relating to operation of the rod pump and/or generating a down-hole dynamometer card, without the need for external instrumentation such as down-hole sensors, rod load sensors, flow sensors, acoustic fluid level sensors, etc. In some embodiments disclosed by Beck et al., having a pumping apparatus driven by an electric motor, instantaneous current and voltage, together with pump parameters estimated through the use of a computer model of the sucker-rod pump, are used in determining rod position and load. The rod position and load are used to control the operation of the rod pump to optimize operation of the pump. Beck et al. also discloses a pump-stroke amplifier that is capable of increasing pump stroke without changing the overall pumping speed, or in the alternative, maintaining the well output with decreased overall pumping speed.

The inherent difficulties of operating a sucker-rod pump apparatus may also be compounded by the type of pumping apparatus, such as the typical walking-beam-type apparatus. The problems encountered when using these conventional pumping systems serve as ample evidence of the desirability of providing a new and improved pumping apparatus for use with a sucker-rod pump.

For example, conventional walking beam-type pumping mechanisms must typically be mounted on a heavy concrete foundation, which may be poured in place or pre-cast, located adjacent the well head. Construction of a walking beam pumping mechanism, together with its foundation, typically involves the efforts of several construction workers, over a period which may be a week or more, to prepare the site, lay the foundation, and allow time for the foundation to cure, in addition to the time required for assembling the various components of the walking beam mechanism onto the foundation and operatively connecting the mechanism to the pump rod.

Because of the costs of transporting the apparatus and the concrete or pre-cast foundation to what may be a remote site and the complexity of the site preparation and assembly process, walking beam-type pumping mechanisms are generally only utilized in long-term pumping installations. Further, the large size and massive weight of the walking beam pumping mechanism and its foundation may also problematic when the well is decommissioned. Economic and contractual obligations may require complete removal of the walking beam mechanism and its foundation.

Linear rod pumping systems have been developed to address a number of the above-described problems with conventional pumping systems. Linear rod pumping systems are disclosed in U.S. Pat. Nos. 8,152,492 and 8,641,390 both issued to Beck et al., and both titled "Linear Rod Pump Apparatus and Method", the entire teachings and disclosures of which are incorporated herein by reference thereto.

Embodiments of the present invention represent an advancement over the state of the art in pumping systems. These and other advantages of the invention, as well as additional inventive features, will be apparent from the description of the invention provided herein.

BRIEF SUMMARY OF THE INVENTION

In one aspect, embodiments of the invention provide a tandem motor linear rod pumping apparatus for imparting reciprocating substantially vertical motion to a pump rod for a sucker-rod pump. The tandem motor linear rod pumping apparatus includes first and second linear mechanical actuator systems for imparting and controlling vertical motion of the pump rod. The first and second linear mechanical actuator systems are constructed to operate with a single housing. The first linear mechanical actuator system includes a first rack and pinion gearing arrangement with a first rack configured to impart a reciprocating motion along a pumping axis. The first rack is operatively connected in a first gear-mesh relationship with a first pinion. The first pinion is operatively connected to a rotating output of a first motor, such that rotation of the first motor in a first direction results in an upward motion of the first rack along the pumping axis, and rotation of the first motor in a second direction opposite the first direction results in a downward motion of the first rack along the pumping axis. The first rack is also operatively connected to the pump rod such that vertically-upward motion of the first rack imparts a vertically upward motion to the pump rod, and such that the pump rod exerts a substantially vertically downward directed force along the pumping axis, during a portion of a pump stroke. The second linear mechanical actuator system includes a second rack and pinion gearing arrangement with a second rack configured to impart reciprocating motion along the pumping axis. The second rack is operatively connected in a second gear-mesh relationship with a second pinion. The second pinion is operatively connected to a rotating output of a second motor, such that rotation of the second motor in the first direction results in an upward motion of the second rack along the pumping axis, and rotation of the second motor in the second direction opposite the first direction results in a downward motion of the second rack along the pumping axis. The second rack is also operatively connected to the pump rod such that vertically-upward motion of the second rack imparts a vertically upward motion to the pump rod, and such that the pump rod exerts a substantially vertically downward directed force along the pumping axis, during the portion of the pump stroke. The first motor has a reversibly rotatable element operatively connected to the first pinion which engages the first rack to establish a fixed relationship between the rotational position of the first pinion and the vertical position of the first rack. The second motor has a reversibly rotatable element operatively connected to the second pinion which engages the second rack to establish a fixed relationship between the rotational position of the second pinion and the vertical position of the second rack. An electronic controller is operatively connected to at least one of the first and second motors, for controlling the first and second motors. The electronic controller operates each motor in a driving mode to urge upward movement of its respective rack and of the pump rod, and operates each motor in a driving or braking mode during downward movement of its respective rack on a downward portion of the stroke of the pump rod.

In particular embodiments, the electronic controller includes two or more sensors for sensing at least one of a linear position of the first and second racks along the pumping axis, a rotational position of each of the two pinions about a respective pinion axis, a motor torque for each of the two motors, a motor speed for each of the two motors, a motor acceleration for each of the two motors, and a motor input power for each of the two motors. Further, the tandem motor arrangement may be configured to equalize the torque placed on the pump rod via operation of the controller or through the use of motors designed to provide equal outputs, thus synchronizing a rotational position of the rotatable elements of the two motors. More specifically, the electronic controller may be configured to control the first and second motors to equalize the torque placed on the pump rod. In alternate embodiments, the first and second motors are of the same size so as to substantially equalize the torque placed on the pump rod. In yet another embodiment, a first electronic controller controls the first motor and a second electronic controller controls the second motor to substantially equalize the torque placed on the pump rod.

In some embodiments, the first and second racks comprise a single member with a first set of teeth disposed on a first side of the member, and a second set of teeth disposed on a second side of the member different from the first side, and wherein the first pinion engages the first set of teeth and the second pinion engages the second set of teeth. In a particular embodiment, the first set of teeth faces a first direction, and the second set of teeth face a second direction 180 degrees from the first direction. In alternate embodiments, the first rack has a first set of teeth and second rack has a second set of teeth, and the first and second racks are separate members that are fixedly connected together.

In certain embodiments, the rack of the first linear mechanical actuator system extends vertically, and the rack of the second linear mechanical actuator system extends vertically. The two racks are parallel within the housing and parallel with a pumping axis. In some embodiments, the motor of the first linear mechanical actuator system is disposed on a first exterior side of the housing, and the motor of the second linear mechanical actuator system is disposed on a second exterior side of the housing opposite the first exterior side.

In another aspect, embodiments of the invention provide a method for operating a tandem motor linear rod pumping apparatus that includes first and second linear mechanical actuator systems each having a motor, and also includes a rod for a sucker rod pump. The method calls for constructing the first and second linear mechanical actuator systems to operate within a single housing, and simultaneously operating each of the two motors in a manner that imparts reciprocating vertical motion to respective-vertically movable members of the first and second linear mechanical actuator systems. Each motor has a reversibly rotatable element that is operatively connected to the vertically-movable member of its respective linear mechanical actuator system, thus establishing a fixed relationship between the rotational position of the rotatable element and the vertical position of its respective vertically-movable member. The simultaneous operation of the two motors imparts a reciprocating vertical motion to the pump rod of the sucker-rod pump.

In some embodiments, each vertically-movable member includes a rack, and each rotatable element includes a pinion. In a further embodiment, the racks of the first and second linear mechanical actuator systems each have a plurality of vertically-adjacent teeth along one side of the rack. The teeth of one rack face away from the other rack, and face 180 degrees from the direction faced by the gears of the other rack. The method may also include aligning the two racks such that they are parallel to each other, and such that the teeth of one rack faces a first direction, and the teeth of the other rack faces a second direction 180 degrees from the first direction.

The method may further include disposing the rack of the first linear mechanical actuator system on a first side of the pump rod, and disposing the rack of the second linear mechanical actuator system on a second side of the pump rod opposite the first side of the pump rod. Embodiments of the method may also include sensing at least one of a linear position of each of the two racks along the pumping axis, a rotational position of each of the two pinions about a respective pinion axis, a motor torque for each of the two motors, a motor speed for each of the two motors, a motor acceleration for each of the two motors, and a motor input power for each of the two motors.

The method may include synchronizing the positions of the two rotatable elements to equalize the torque placed on the pump rod. Synchronization may be aided by using two motors designed to produce equal torques to their respective rotational elements. Embodiments of the method include sensing a vertical position of each of the two racks along a pumping axis, and synchronizing control of the respective motors according to the sensed vertical positions so as to minimize a moment on the pump rod and well casing. The method may further include disposing the motor of the first linear mechanical actuator system on a first exterior side of the housing, while disposing the motor of the second linear mechanical actuator system on a second exterior side of the housing opposite the first exterior side.

In yet another aspect, embodiments of the invention provide an oil pumping system that includes an oil return line configured to carry oil from an oil sump in a first portion of a pump housing to an internal oil reservoir in a second portion of the pump housing. A top plate is attached to a portion of a pump rod such that the top plate moves up and down in accordance with a reciprocating motion of the pump rod. A bottom plate is located below the top plate. A pump mechanism is disposed between the top plate and bottom plate. The pump mechanism includes a valve seat with a bottom portion configured to contact the bottom plate, and an upper portion configured to contact the top plate. A first biasing element is configured to urge the valve seat upward away from the bottom plate. A plunger is configured to seat within the upper portion of the valve seat creating a seal therebetween. A second biasing element is configured to urge the plunger upward away from the valve seat. Upward movement of the pump rod and attached top plate allows oil to flow into an interior portion of the pump mechanism that is in fluid communication with the oil return line. Downward movement of the pump rod and attached top plate causes the plunger to seat within the valve seat and causes the bottom portion of the valve seat to seal against the bottom plate such that oil flows into the oil return line and up towards the internal oil reservoir.

In a particular embodiment, the first and second biasing elements include first and second springs, respectively. The bottom portion of the valve seat may be cylindrical, while the upper portion of the valve seat may be annular. Additionally, the upper portion may have a rim that seats against a top end of the first spring.

In certain embodiments, the oil return line includes a check valve that only allows the oil to flow upward to the oil reservoir. Furthermore, the oil return line may include a filter to filter out solid contaminants from the oil.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
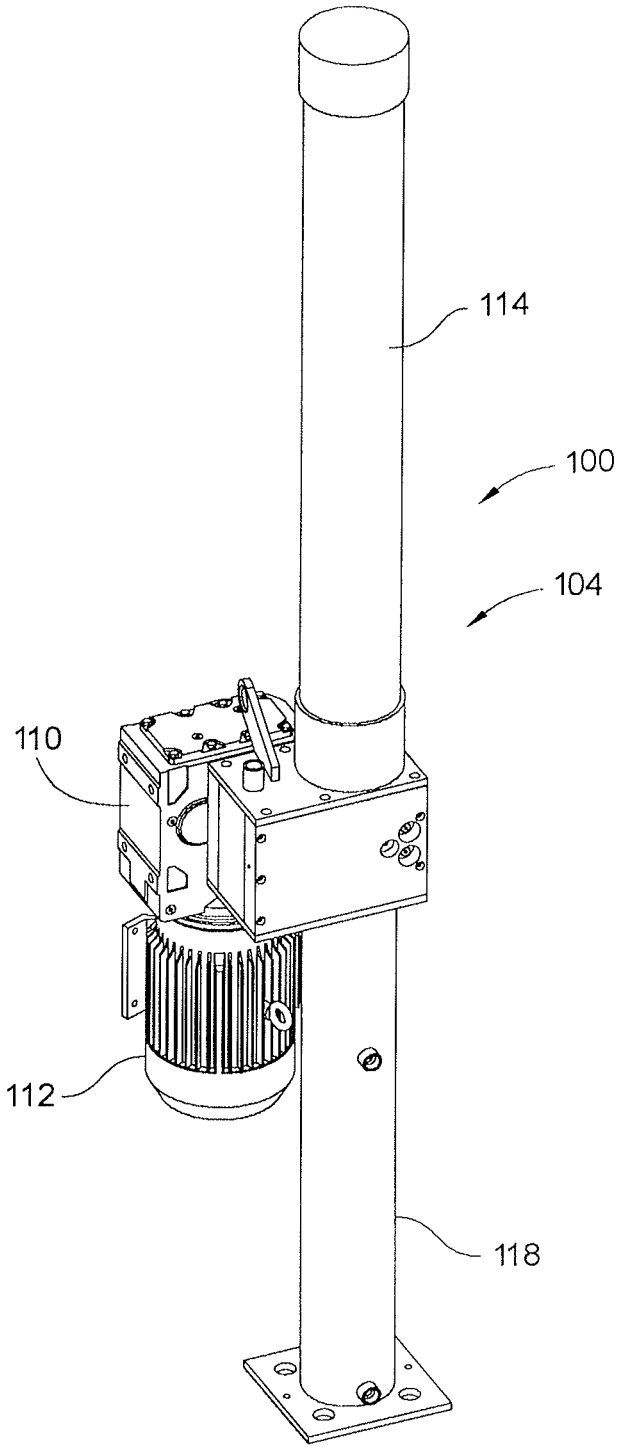
FIG. 1 is a perspective view of a linear rod pumping apparatus.
Figure 2:
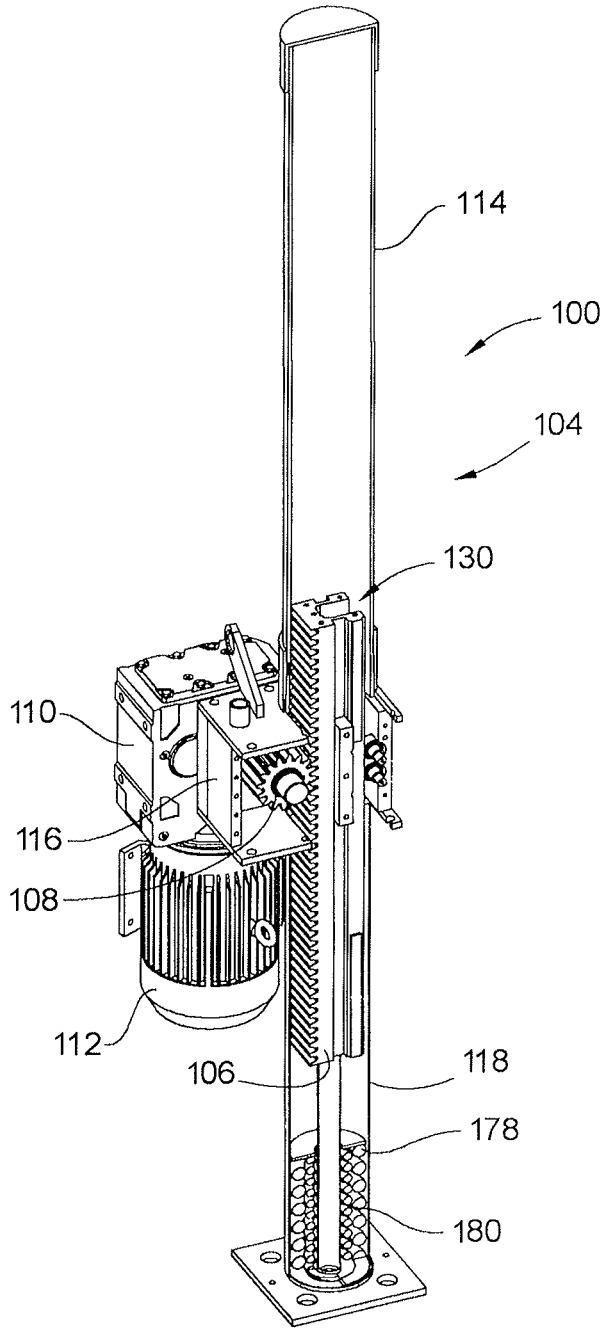
FIG. 2 is a partially cut-away perspective view of the linear rod pumping apparatus of FIG. 1.
Figure 3:
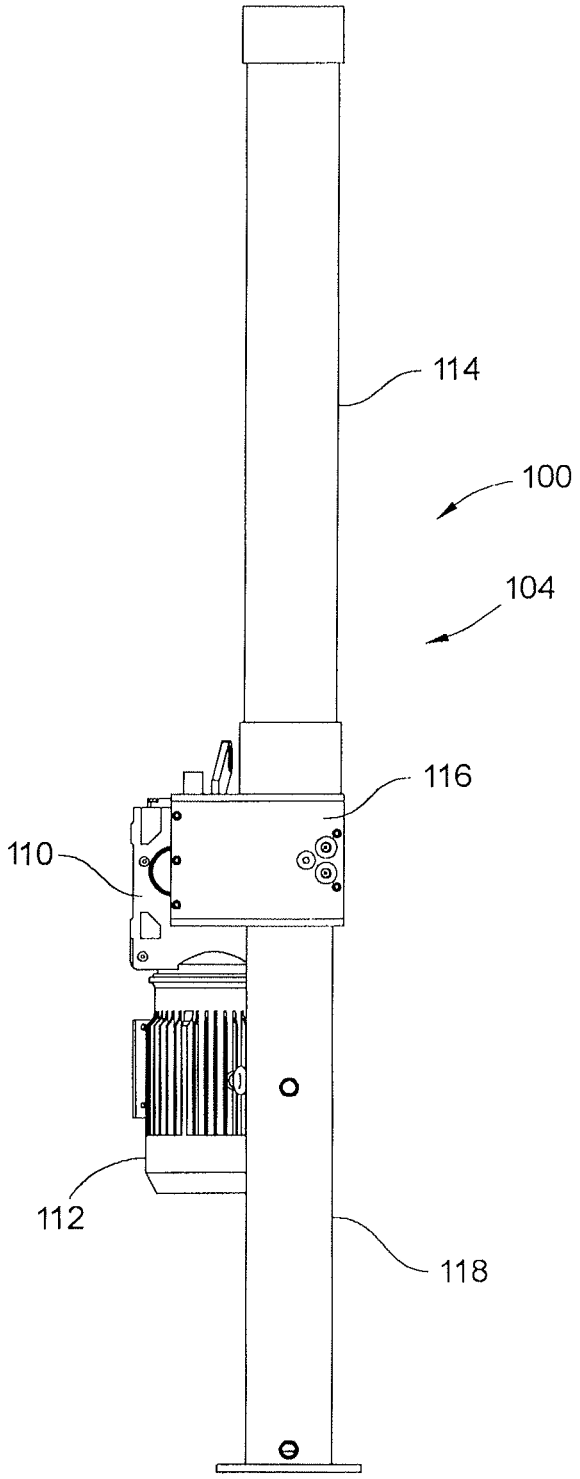
FIG. 3 is a orthographic illustration of the linear rod pumping apparatus of FIGS. 1 and 2.

FIGS. 1 and 2 show a perspective view and a perspective cross-sectional view, respectively, of a linear rod pumping apparatus 100. FIG. 3 shows a plan view of the linear rod pumping apparatus 100. The linear rod pumping apparatus 100 includes a linear mechanical actuator system 104 which, in turn, includes a rack and pinion gearing arrangement having a rack 106 and a pinion 108 operatively connected through a gearbox 110 to be driven by a reversible electric motor 112 in a manner described in more detail below.

Figure 4:
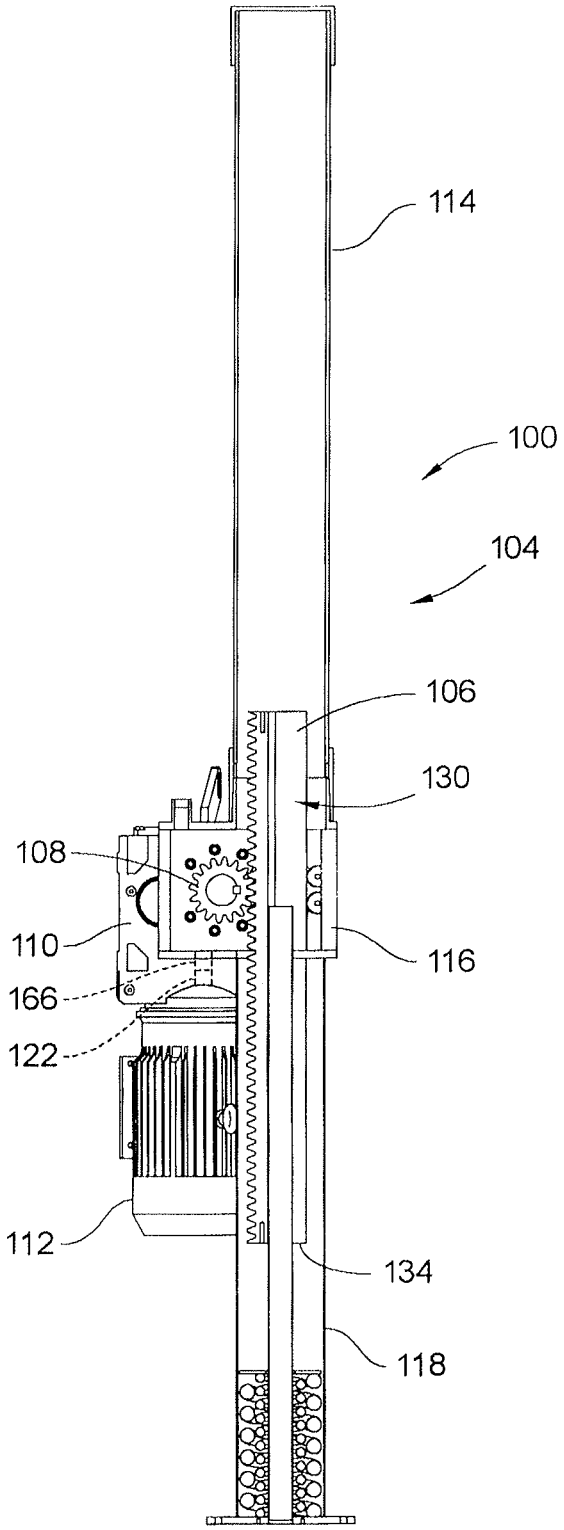
FIG. 4 is a partially cut-away perspective view of the linear rod pumping apparatus of FIG. 3.
Figure 5:
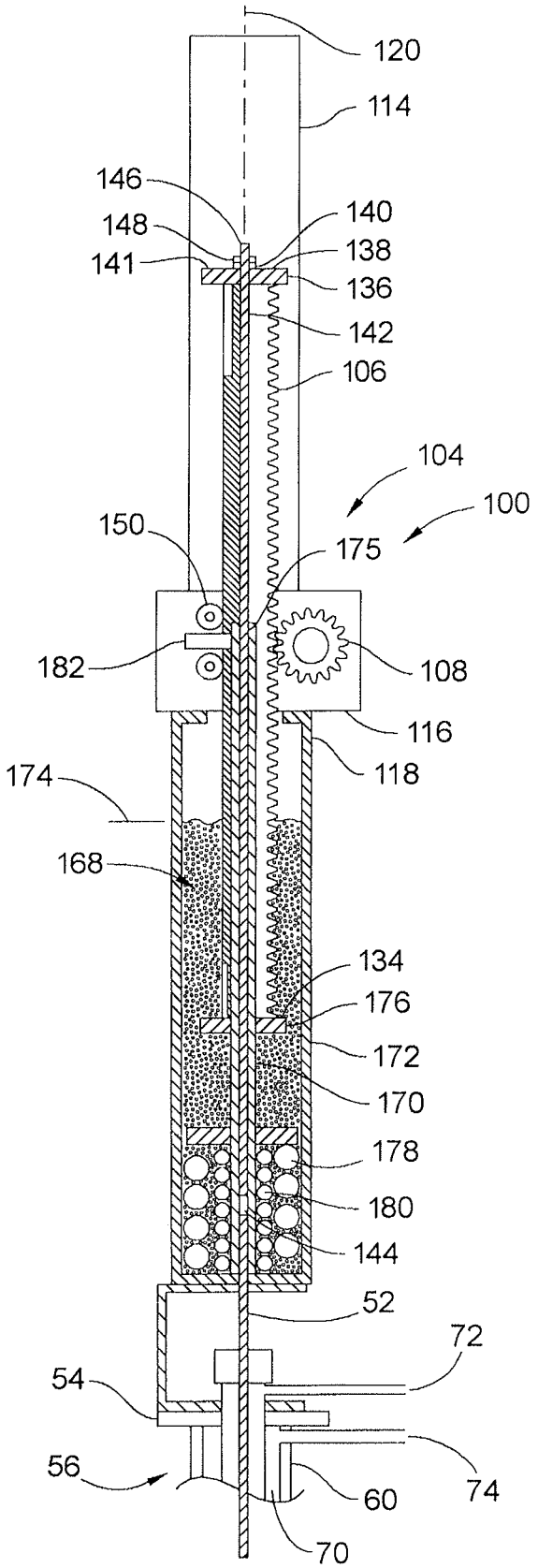
FIG. 5 is a schematic cross-sectional view of a linear rod pumping apparatus.

As shown schematically in FIGS. 2, 4, and 5, the linear mechanical actuator system 104 of the linear rod pumping apparatus 100 includes a rack and pinion gearing arrangement 106, 108 with the rack 106 being disposed for operation in a substantially vertical direction for reciprocating motion within a three piece housing having an upper, middle and lower section 114, 116, 118 along a substantially vertically-oriented pumping axis 120. The rack 106 is operatively connected in gear mesh relationship with pinion 108 and the pinion 108 is operatively connected to a rotating output shaft 122 of the motor 112 such that rotation of the motor output shaft in a first direction is accompanied by a substantially vertically upward motion of the rack 106 along the pumping axis 120, and such that a substantially vertically downward motion of the rack 106 along the pumping axis 120 is accompanied by rotation of the motor output shaft 122 in a second direction opposite the first direction. The rack 106 is also operatively connected to the pump rod 52 of the sucker-rod pump 68 (shown in FIG. 8), such that the rack 106 cannot exert a substantially vertically downward directed force on the pump rod 52.

A longitudinally directed channel 130 in the rack 106 extends along the pumping axis 120 from a lower end 134 of the rack 106 to a top end 136 of the rack 106, with the upper end 136 of the rack 106 being adapted for operative attachment thereto of the pump rod 52. Specifically, as shown in FIG. 5, the upper end 136 of the rack 106 includes a top plate 138 having a hole 140 extending therethrough and defining an upper load bearing surface 141 of the upper end 136 of the rack 106.

The linear mechanical actuator apparatus 104 of the linear rod pumping apparatus 100 includes an actuator rod 142, having a lower end 144 thereof fixedly attached to the top end of the pump rod 52 by a threaded joint or other appropriate type of coupling. The actuator rod 142 extends upward from the lower end 144, through the channel 130 in the rack 106 and the hole 140 in the top plate 138 of the rack 106, and terminates at and upper end 146 of the actuator rod 142 which is disposed above the bearing surface 141 on the upper surface of the top plate 138 of the rack 136. A rod clamp 148 is fixedly attached below the upper end 146 of the actuator rod 142 and above the upper end 136 of the rack 106. The clamp 148 has a lower load bearing surface thereof adapted for bearing contact with the upper load bearing surface 141 of the upper end 136 of the rack 106, for transferring force between the actuator rod 142 and the upper end 136 of the rack 106 when the lower load bearing surface of the clamp 148 is in contact with the upper load bearing surface 141 on the upper end 136 of the rack 106.

The clamp 148 forms an expanded upper end of the actuator rod 142 having a configuration that is incapable of entry into or passage through the hole 140 in the upper end 136 of the rack 106. It will be further appreciated that, to facilitate installation of the linear rod pumping apparatus 100 on a well head 54, the actuator rod 142 may be allowed to extend some distance beyond the collar 148, to thereby provide some measure of adjustment to accommodate variations in the positioning of the upper end of the pump rod 52, with respect to the lower end of the lower section 118 of the housing of the linear mechanical actuator system 104. The upper section 114, of the housing of the linear mechanical actuator system 104 includes sufficient head space to accommodate a portion of the actuator rod 142 extending above the clamp 148.

To further reduce the size of the linear rod pumping apparatus 100, the gearbox 110 is a right angle gear box having input element 166. In some embodiments, the input element 166 of gearbox 110 and the rotatable shaft 122 of motor 112 are oriented substantially parallel to the pumping axis 120. It will be understood that, in other embodiments of the invention, the motor 112 may be operatively attached to the pinion 108 by a variety of other means and in other relative orientations.

Figure 8:
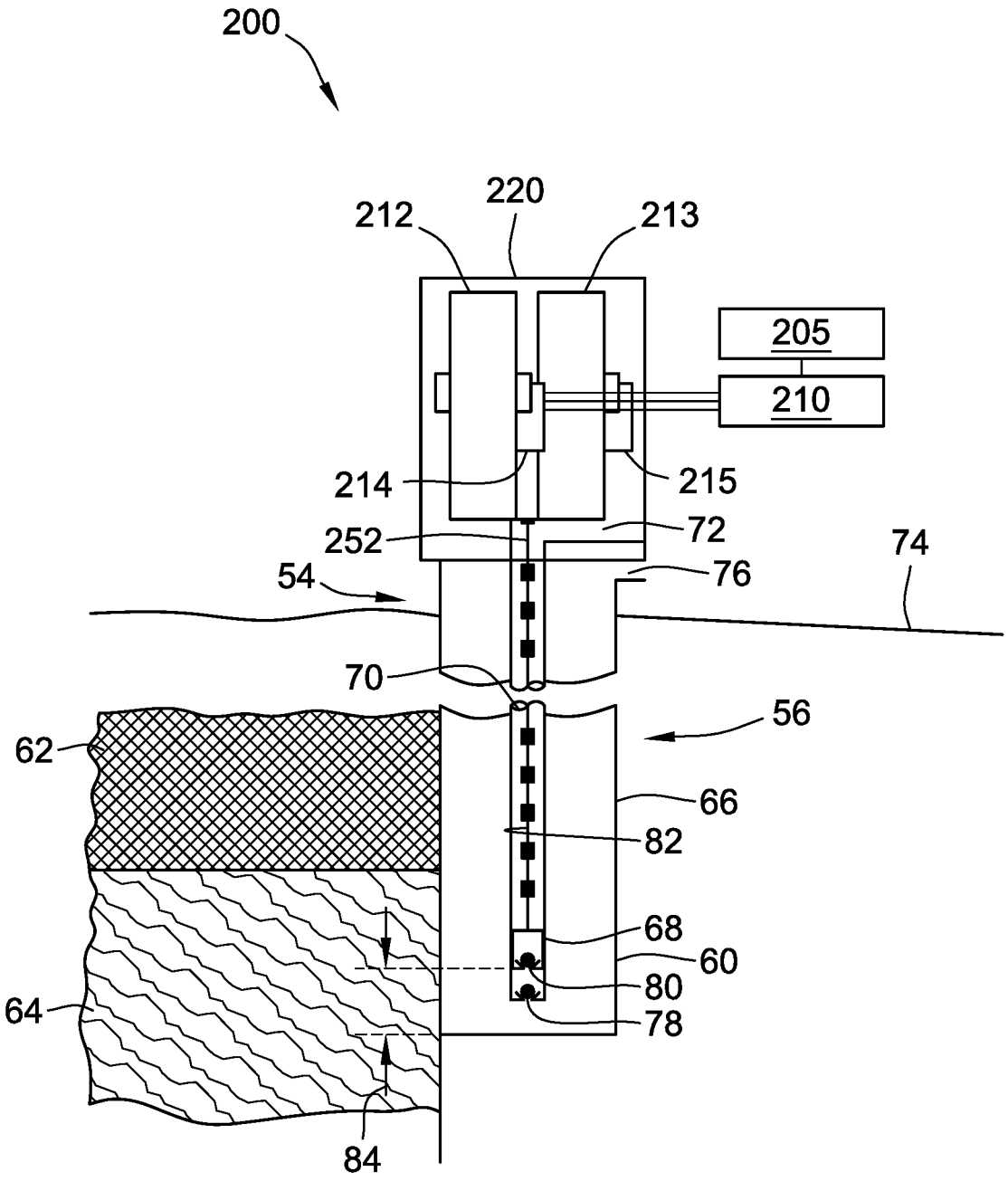
FIG. 8 is a schematic illustration of the tandem motor linear rod pumping system mounted on the well head of a hydrocarbon well, according to an embodiment of the invention.

As best seen in FIG. 5, the linear mechanical actuator system 104, of the second exemplary embodiment 100 of the invention, also includes an oil sump 168, formed by the lower section 118 of the housing, and configured to contain a sufficient volume of lubricant therein, such that a lower portion of the rack 106 is immersed into the lubricant during at least a portion of each pump stroke 84 of the sucker-rod pump 68 (shown in FIG. 8). The oil sump 168 includes inner and outer longitudinally extending radially spaced tubular walls 170, 172 sealingly connected at lower ends thereof by the bottom end of the lower section 118 of the housing, to thereby define an annular-shaped cavity therebetween, for receipt within the cavity of the volume of the lubricant, and terminating in an annular-shaped opening between upper ends of the inner and outer tubular walls 170, 172.

As shown in FIG. 5, the inner tubular wall 170 extends substantially above a fluid level 174 of the lubricant within the oil sump 168, even when the rack 106 is positioned in a maximum downward location thereof, so that the lubricant is precluded from flowing over the top end 175 of the inner tubular wall 170. By virtue of this arrangement, it is not necessary to provide any sort of packing in the linear mechanical actuator system 104 between the lower end of the lower section 118 of the housing and the pump rod 52, or the actuator rod 142.

It will be noted, however, that in other embodiments of the invention, other arrangements for providing lubrication of the rack 106 in the oil sump 168 may be utilized, wherein it would be desirable to provide a packing between the rod 52, 142 and the lower end of the lower section 118 of the housing of the linear mechanical actuator system 104. In particular embodiments of the invention, it may be desirable to have the cross-sectional area of the oil sump 168 match the cross-sectional area of the rack 106, or a lower end plate 176 closely enough so that immersion of the rack 106 into the oil sump 168 generates hydraulic damping of the movement of the rack 106.

FIGS. 9-12 In a particular embodiment, the tandem motor linear rod pumping apparatus 200 has an oil pump system 300 that uses the movement of the a first rack 206 and a second rack 207 to circulate the oil. Thus, unlike conventional oil pumps on downhole pumping systems, the oil pump system 300 does not require an external power source. Conventional downhole oil pumps transport oil from the well bottom up to the components at the well head. These systems require a control apparatus configured to sense when oil is needed and to determine which pump strokes oil is to be transported up from the well bottom. Compared to conventional downhole oil pumps, oil pump system 300 is less expensive and easier to operate and maintain in that it does not require the elaborate control system required by conventional oil pumping systems.

Figure 9:
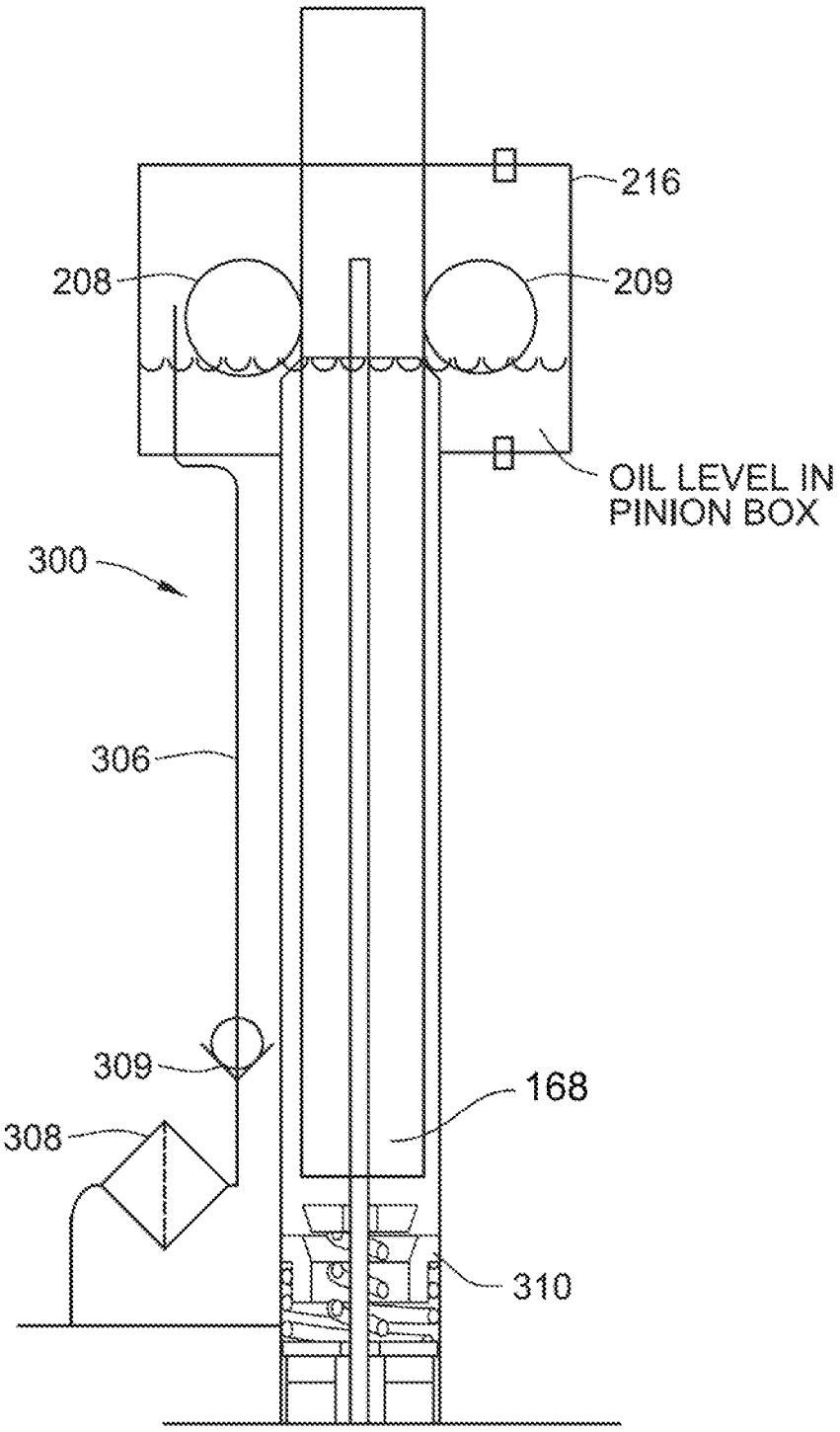
FIG. 9 is a schematic diagram of an oil pumping device, constructed in accordance with an embodiment of the invention.

As shown in FIG. 9, the oil pump system 300 includes an oil-filled pinion box 216 which is referred to above as the middle section 116 of the three-piece housing, and which acts as an above-ground oil reservoir. The oil level in the oil-filled pinion box 216 is high enough to keep the first and second pinions 208, 209 and a portion of the first and second racks 206, 207 at least partially submerged in oil. The reciprocating movement of the first and second racks 206, 207 acts to pump oil from the oil sump 168 in the lower section 118 of the housing through an oil return line 306 to the oil-filled pinion box 216.

A pump valve mechanism 310 is located in the bottom section 304. The pump valve mechanism 310 feeds oil to the oil return line 306, which may include a filter 308 disposed in the oil sump 168 in the lower section 118 of the housing. The filter 308 acts to filter out solid contaminants from the oil in the oil return line 306. In some embodiments, the filter 308 has a replaceable cartridge to simplify filter maintenance. The oil return line 306 may also include a check valve 309 so that only a flow of oil from the oil sump 168 in the lower section 118 of the housing to the oil-filled pinion box 216.

Figure 10:
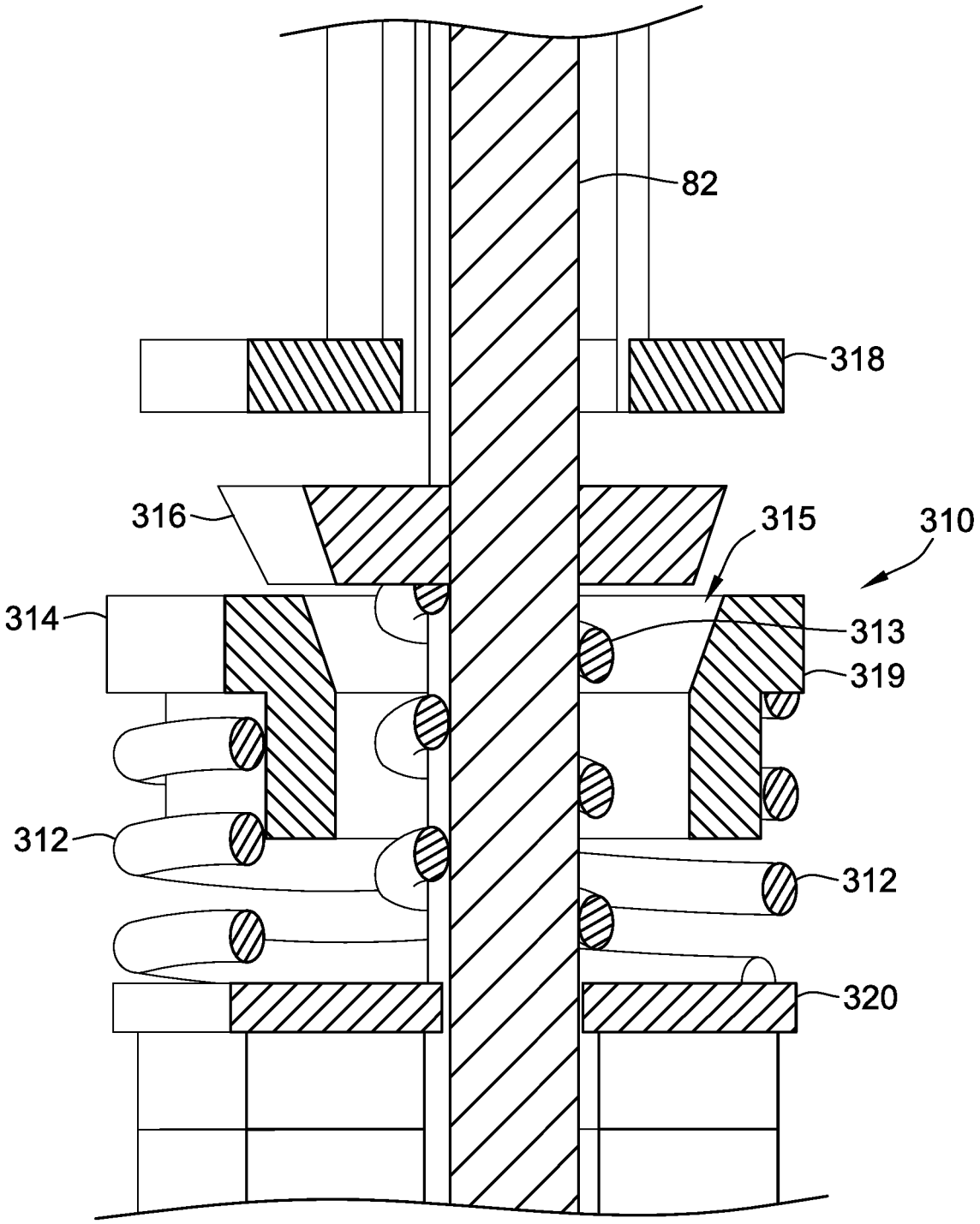
FIGS. 10-12 are cross-sectional views of a portion of the oil pumping device shown in FIG. 9.
Figure 11:
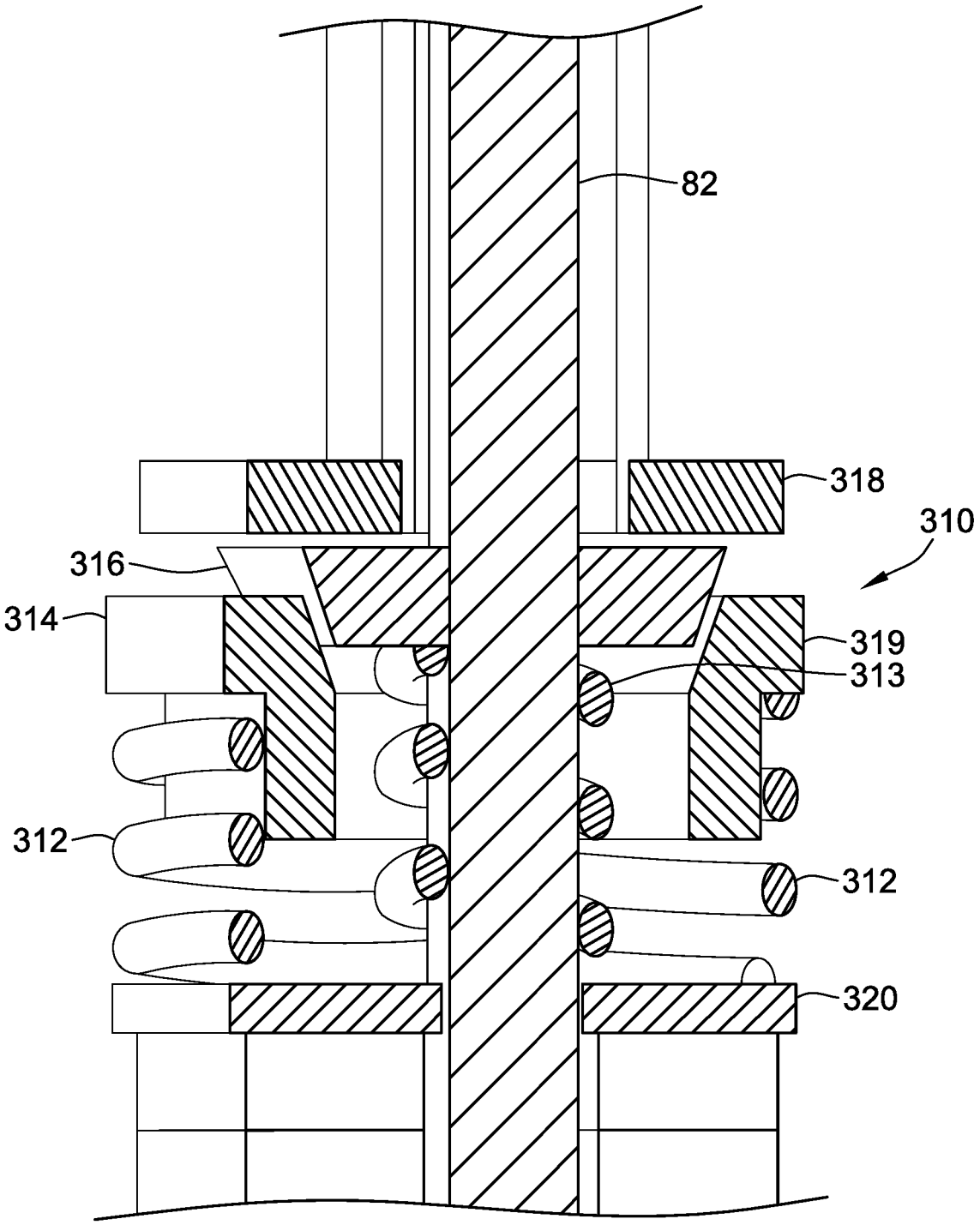
Figure 12:
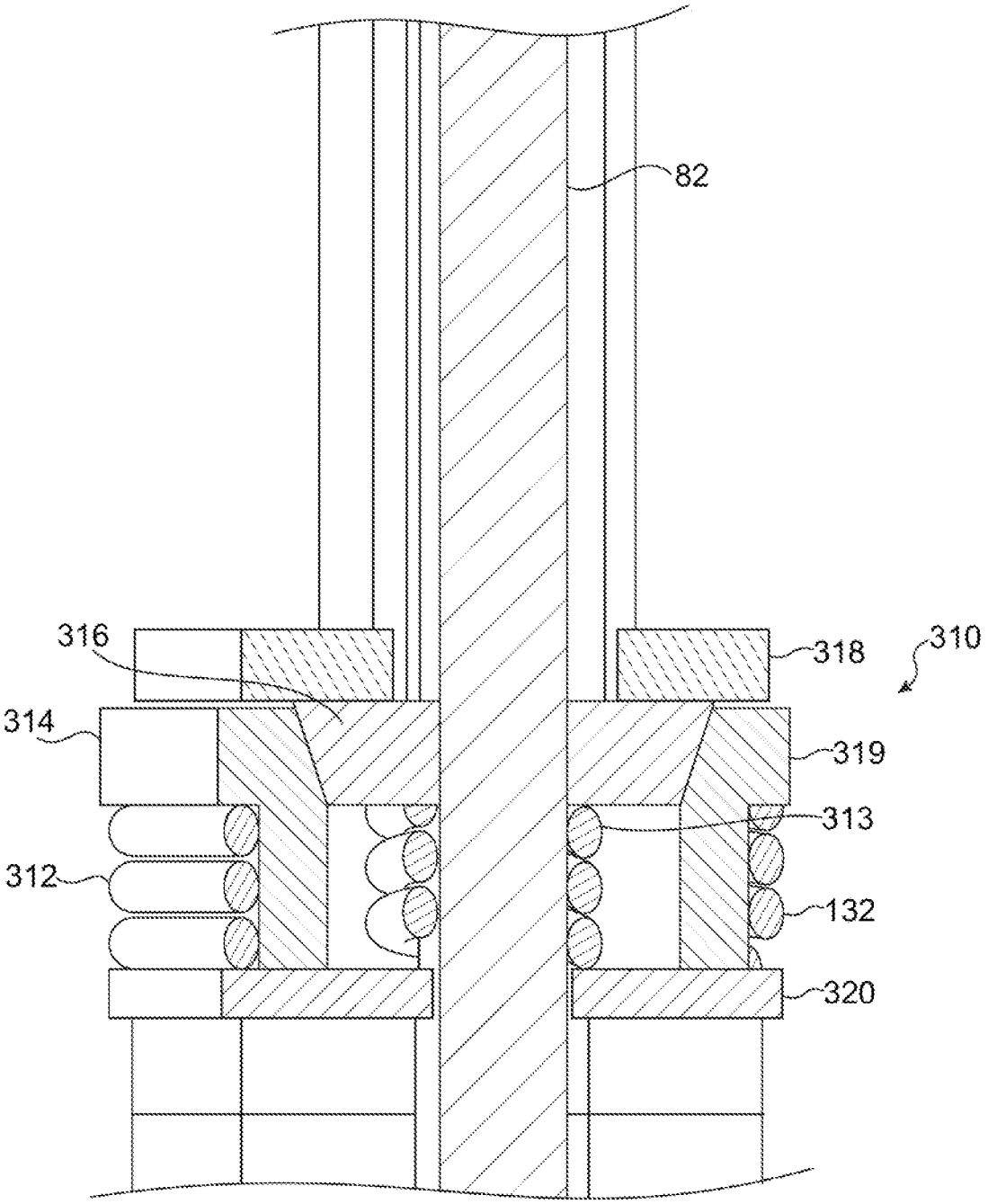

FIGS. 10-12 show a close up view of the pump valve mechanism 310, according to an embodiment of the invention. The pump valve mechanism 310 includes biasing elements in the form of first and second springs 312, 313, a valve seat 314, a plunger 316, bottom plate 320, and a top plate 318. The first and second springs 312, 313 rest on the bottom plate 320. In the embodiment shown, the valve seat 314 is cylindrical. The cylindrical valve seat 314 has an upper portion in the form of a rim 319, which is annular in the embodiment of FIGS. 10-12, such that the valve seat 314 inserts into the top of the first spring 312. However, the rim 319 allows the valve seat 314 to rest on the top of the first spring 312. The cylindrical valve seat 314 has a bottom portion 321, which in the embodiment shown is cylindrical, with a flat bottom which can seal against the bottom plate 320.

FIG. 10 illustrates the pump valve mechanism 310 during the upward portion of each pump stroke. The top plate 318, which is attached to the first and second racks 206, 207 (shown in FIG. 7), is raised well above the plunger 316. The second spring 313 biases the plunger 316 above valve seat 314, which is biased above the bottom plate 320 by the first spring 312, such that some of the oil in the oil sump 168 in the lower section 118 of the housing can flow into an interior portion 315 of the pump valve mechanism 310. The interior portion 315 is in fluid communication with the oil return line 306 (shown in FIG. 9).

FIG. 11 illustrates the pump valve mechanism 310 during the downward portion of each pump stroke during which the first and second racks 206, 207 (shown in FIG. 7) lowers the top plate 318. The top plate 318 contacts and pushes down on the plunger 316 and compresses the second spring 313. As the plunger 316 seats within the valve seat 314 creating a seal therebetween, the top plate 318 also contacts and pushes down on the valve seat 314. The seating of the plunger 316 in the valve seat 314 compresses the oil in the interior portion 315 of the pump valve mechanism 310.

FIG. 12 illustrates the pump valve mechanism 310 at the bottom of the downward pump stroke. The plunger 316 is firmly seated in the valve seat 314. The first and second springs 312, 313 are fully compressed and the bottom of the valve seat 314 is sealed against the bottom plate 320. Oil in the interior portion 315 of the pump valve mechanism 310 is forced into the oil return line 306 (shown in FIG. 9). Each upward pump stroke fills the interior portion 315, while each downward pump stroke forces oil into the oil return line. The check valve 309 (shown in FIG. 9) ensures that the flow of oil can only move upward toward the oil-filled pinion box 116. In this manner, the oil pump system 300 continuously pumps oil from the bottom of the well to the first and second racks 206, 207 and first and second pinions 208, 209 using only the reciprocating motion of the rod string 82 for power.

Referring again to FIG. 5, the linear mechanical actuator system 104 includes a stack of urethane bumpers 178, 180 operatively positioned within the annular cavity in the bottom of the sump 168, below the lower end 134 of the rack 106, and configured for engaging and applying an upwardly-directed force to the lower plate 176 on the lower end 134 of the rack 106, when the lower end plate 176 comes into contact with a longitudinally movable spring contact plate 182 configured to rest on an upper end of the urethane bumpers 178, 180 and move longitudinally along the inner tubular wall 170 as the urethane bumpers 178, 180 act on the lower end 134 of the rack 106.

In certain embodiments, the urethane bumpers 178, 180 are configured for engaging and applying an upwardly-directed force to the lower end 134 of the rack 106 only when the lower end 134 of the rack 106 has moved beyond a normal lower position of the rack 106 during a pump stroke. Such an arrangement provides a safety cushion to safely bring the rack 106 and rod string 82 (shown in FIG. 8) slowly to a halt in the event that a fault condition should result in the rack 106 moving downward to a longitudinal position lower than would be attained during a normal pump stroke. By virtue of this arrangement, a potentially damaging impact between components of the linear mechanical actuator system 104 and of the stationary and traveling valves 78, 80 members of the sucker-rod pump 68 (shown in FIG. 8) is precluded.

In other embodiments of the invention, however, the urethane bumpers 178, 180 may be configured in such a manner that they engage and apply an upwardly-directed force to the lower end 134 of the rack 106 during a portion of each pump stroke 84 (shown in FIG. 8), to thereby recover a portion of the kinetic energy generated by the weight of the rod string 82 and sucker-rod pump 68 (shown in FIG. 8) during the downward portion of the pump stroke 84 under the force of gravity and utilize that stored energy in the urethane bumpers 178, 180 for aiding the action of the linear rod pumping apparatus 100 during the upward portion of the stroke, in addition to precluding mechanical damage the rack 106 or other components at the bottom of each pump stroke 84.

In conventional single-motor downhole pumping systems, when seeking to increase the pumping capacity of the downhole pumping system, there are practical limits to how much one can increase the size of the motor. In single-motor systems, the torque from rotational movement of the motor generates a bending moment on the pump rod, rack, and well casing. As the size of the motor increases, the bending moment on the rack, well casing, and pump rod can cause premature wear of the rack, and in extreme cases failure of the rack. As will be explained below, embodiments of the present invention disclose a tandem motor arrangement which can reduce or eliminate the bending moment on the rack, well casing, and pump rod.

Figure 6:
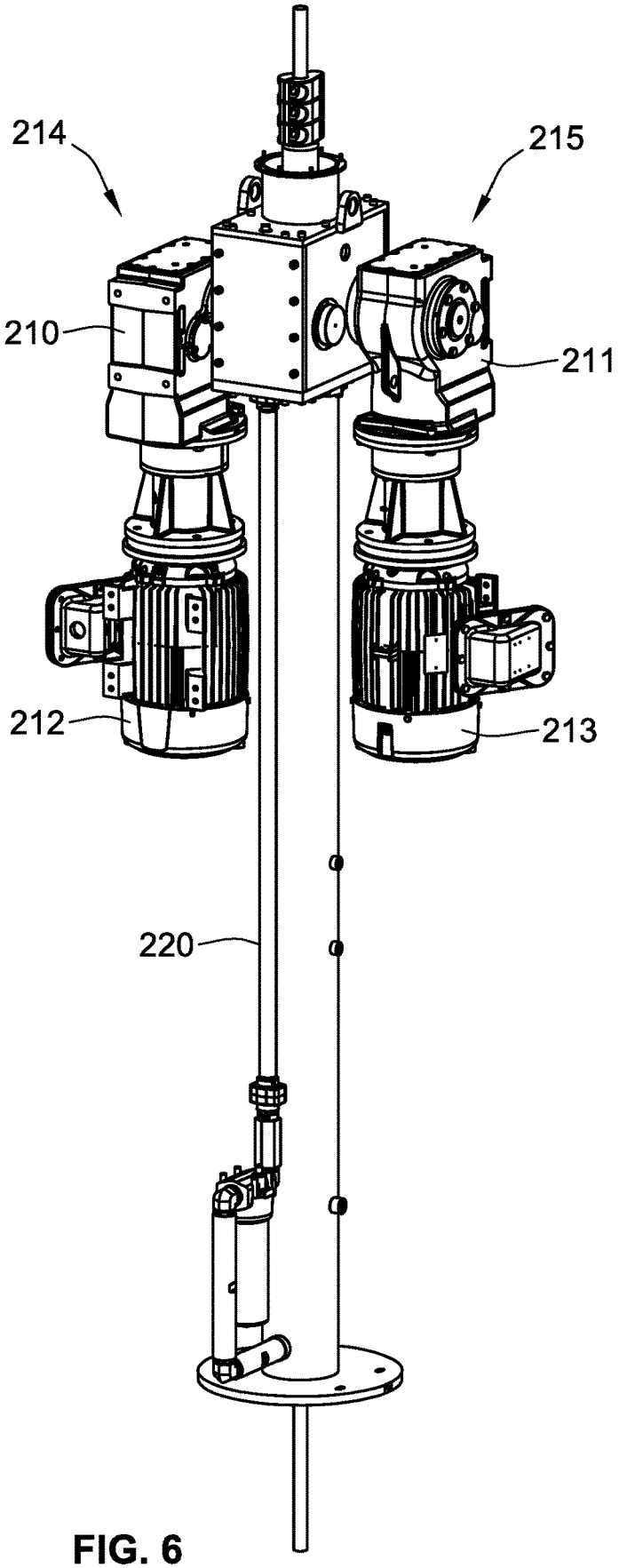
FIG. 6 is a perspective view of a tandem motor linear rod pumping system, according to an embodiment of the invention.
Figure 7:
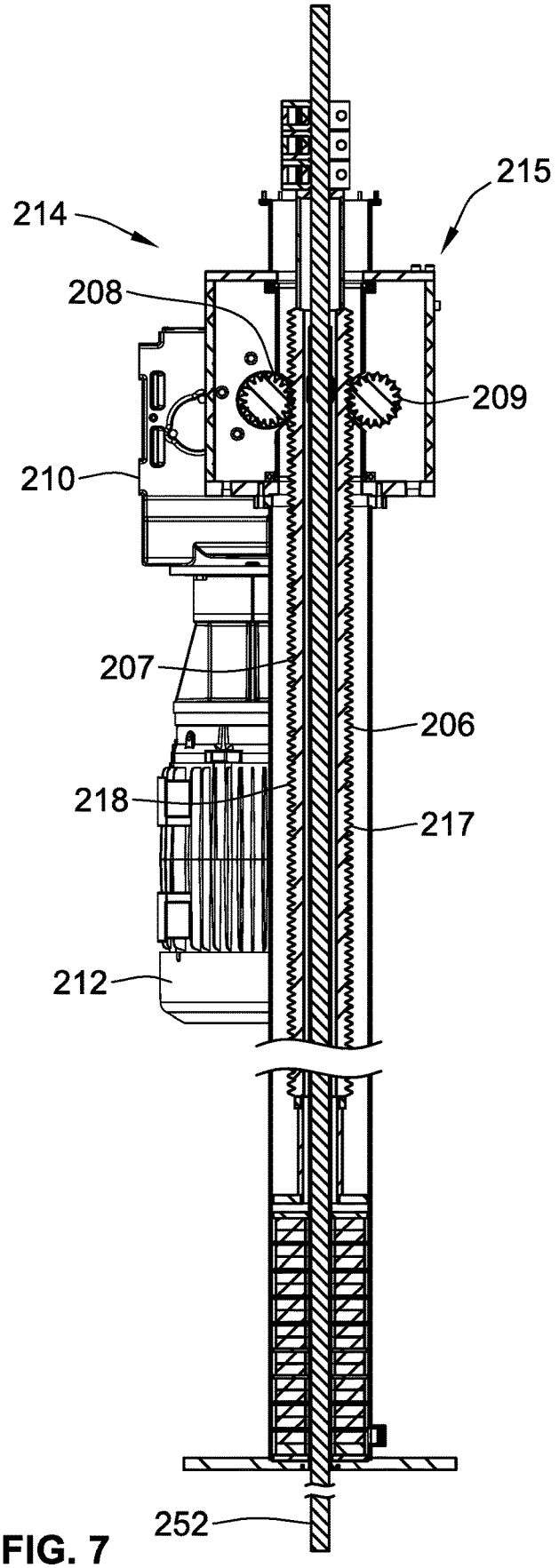
FIG. 7 is a cross sectional view of the tandem motor linear rod pumping system, according to an embodiment of the invention.

FIGS. 6-7 illustrate a perspective view and cross-sectional view, respectively, of an exemplary embodiment of a tandem motor linear rod pumping system 200. As can be seen from the embodiments of FIGS. 6-7, the tandem motor linear rod pumping system 200 includes a pump rod 252 coupled to first and second linear mechanical actuator systems 214, 215. The pump rod 252 is disposed in a single housing 220 and down a single well/hole.

As in the embodiment described above, the first linear mechanical actuator system 214 has a first pinion 208 operatively connected through a first gearbox 210, which is driven by a first reversible electric motor 212. The second linear mechanical actuator system 215 has a second pinion 209 operatively connected through a second gearbox 211, which is driven by a second reversible electric motor 213. The first pinion 208 engages gears, in the form of a vertically-extending set of teeth 217, on the vertically-extending first rack 206, while the second pinion 209 engages gears, in the form of a similarly vertically-extending set of teeth 218, located on different sides of a vertically-extending second rack 207. The first and second racks 206, 207 may be constructed from a single piece of material, such as steel or a similar metal for example.

In FIG. 7, the first rack 206 has the first set of teeth 217 disposed on a first side of the single piece of material. The second rack 207 has the set of teeth 218 disposed on a second side of the single piece of material, the second side being different from the first side. As stated above, the first pinion 208 engages the first set of teeth 217, while the second pinion 209 engages the second set of teeth 218. In a particular embodiment, the first set of teeth 217 faces a first direction, and the second set of teeth 218 face a second direction 180 degrees from the first direction. In alternate embodiments, the first rack 206 has the first set of teeth 217 and second rack 207 has the second set of teeth 218, but the first and second racks 206, 207 are separate members that are fixedly connected together to form a single rigid component.

Each motor 212, 213 has a reversibly rotatable element operatively connected to the first and second pinions 208, 209 which, together, engage the first and racks 206, 207 to establish a fixed relationship between the rotational position of the first and second pinions 208, 209 and the vertical position of the first and second racks 206, 207 to impart vertical motion to the pump rod 252, which is connected to the downhole pump 68 (shown in FIG. 8).

With the tandem motor arrangement shown in FIGS. 6-7, it is possible to substantially increase the pumping capacity, as compared to a single-motor linear rod pumping apparatus, while simultaneously reducing the net moment on the pump rod 252 resulting from operation of the motors. Conventional systems employing a single motor may generate a substantial moment on the pump rod 252, rack, and well casing 60. Typically, the moment increases with the size of the motor. By employing two opposing motors to apply roughly equal but opposite torques to the pump rod 252, or by using an electronic controller to equalize the torque placed on the pump rod 252 by synchronizing a rotational position of the rotatable elements of the first and second motors 212, 213, it is possible to double the pump capacity while applying little or no net moment to the pump rod 252 and well casing. It is also envisioned that embodiments of the invention may include a first electronic controller to control the first motor 212, and a second electronic controller to control the second motor 213.

FIG. 8 is a schematic illustration of an exemplary embodiment of the tandem motor linear rod pumping apparatus 200 mounted on the well head 54 of a hydrocarbon well 56. The well includes a casing 60 which extends downward into the ground through a subterranean formation 62 to a depth sufficient to reach an oil reservoir 64. The casing 60 includes a series of perforations 66, through which fluid from the hydrocarbon reservoir enter into the casing 60, to thereby provide a source of fluid for a down-hole pumping apparatus 68, installed at the bottom of a length of tubing 70 which terminates in an fluid outlet 72 at a point above the surface 74 of the ground. The casing 60 terminates in a gas outlet 76 above the surface of the ground 74.

As shown in FIGS. 7 and 8, the tandem motor linear rod pump apparatus 200, according to the invention, includes first and second linear mechanical actuator systems 214, 215 with reversible first and second motors 212, 213, an electronic controller 205 and a motor drive or gearbox 210. In particular embodiments, the electronic controller 205 has one or more sensors for sensing at least one of linear position of the first and second racks 206, 207 along the pumping axis, rotational position of the first and second pinion 208, 209 about their respective pinion axes, motor torque, motor speed, motor acceleration, and motor input power. Additionally, the sensors may be configured to sense a vertical position of the first and second racks 206, 207 along the pumping axis 120 (shown in FIG. 5), and controlling the respective motors 212, 213 according to the sensed vertical positions.

The electronic controller 205 operates the first and second motors 212, 213 in a driving mode to urge upward movement of the first and second racks 206, 207 and of the pump rod 252, and operates the first and second motors 212, 213 in a driving or braking mode during downward movement of the first and second racks 206, 207 on a downward portion of the stroke of the pump rod 252. In all forms of the invention, the first and second linear mechanical actuator systems 214, 215 include one or more substantially vertically movable members, such as the first and second racks 206, 207 attached to the pump rod 252 for imparting and controlling vertical motion of the rod string 82 and the sucker-rod pump 68.

In certain embodiments, the electronic controller 205 controls the first and second motors 212, 213 in such a way as to equalize the torque placed on the pump rod 252, for example, by synchronizing the rotatable elements of the first and second motors 212, 213. Specifically, the electronic controller 205 accomplishes this by controlling the rotational positions of the first and second pinions 208, 209 to synchronize the vertical motion imparted to the first and second racks 206, 207, respectively. In alternate embodiments, the electronic controller 205 uses a single connection to control the first and second motors 212, 213. The electronic controller 205 may be configured to control the first and second motors 212, 213 and the rotational positions of the first and second pinions 208, 209 via programming and the use of specially-designed algorithms, or via specialized and dedicated electronic hardware, or via a combination of the two.

When both motors 212, 213 are controlled by the same control signal in this fashion, the first and second motors 212, 213 may be substantially identical, in terms of generated torque, in order to equalize the torque, and thereby reduce or eliminate the net moment, placed on the pump rod 252. Using identical motors allows for a somewhat simplified operation of the tandem motor linear rod pumping system 200. When each motor 212, 213 is capable of producing the same amount of torque, the tandem motor arrangement will optimally produce twice that amount of torque. This arrangement typically prevents damage to the first and second racks 206, 207 and pump rod 252 from overload, because even if the performance of one motor starts to degrade relative to the other motor, the torque outputs of the two motors 212, 213 will be close enough that the net moment on the pump rod 252 and well casing 60 is not sufficient to cause any damage to the system. By reducing the net moment on the pump rod 252 and well casing 60, it may be possible to increase the length of a typical pump stroke 84 of the pumping system 200

In a certain embodiment, the first and second racks 206, 207 extend vertically along the pumping axis 120 such that the first and second racks 206, 207 are substantially parallel with the pumping axis 120. In the embodiments shown, the first rack 206 has the first set of vertically-adjacent teeth 217 along a side of the first rack 206, while the second rack 207 has the second set of vertically-adjacent teeth 218 along a side of the second rack 207 different from the side of the first rack 206. In some embodiments, the set of teeth 217 on the first rack 206 faces away from the set of teeth 218 on the second rack 207, such that the set of teeth 217 on the first rack 206 face a direction that is 180 degrees from the direction faced by the set of teeth 218 on the second rack 207, and where both sets of teeth 218, 218 face directions that are perpendicular to the pumping axis 120.

In a further embodiment, the first motor 212 of the first linear mechanical actuator system 214 is disposed on a first side of the pump rod 252, and the second motor 213 of the second linear mechanical actuator system 215 is disposed on a second side of the pump rod 252 opposite the first side.

In a particular embodiment, the first down-hole pump 68 includes a stationary valve 78, and a traveling valve 80. The traveling valve 80 is attached to a rod string 82 extending upward through the tubing 70 and exiting the well head 54 at the pump rod 52. Those having skill in the art will recognize that the first down-hole pumping apparatus 68, in an exemplary embodiment of the invention, forms a traditional sucker-rod pump arrangement for lifting fluid from the bottom of the well 56 as the first pump rod 252 imparts reciprocal motion to first rod string 82, and the first rod string 82 in turn causes reciprocal motion of the traveling valve 80 through the pump stroke 84. In a typical hydrocarbon well, the rod string 82 may be several thousand feet long and the pump stroke 84 may be several feet long.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An oil pumping system comprising:

an oil return line configured to carry oil from an oil sump in a pump housing to an oil-filled pinion box in the pump housing;

a top plate attached to a portion of a pinup rod such that the top plate moves up and down in accordance with a reciprocating motion of the pump rod;

a bottom plate located below the top plate a pump mechanism disposed between the top plate and bottom plate, the pump mechanism comprising:

a valve seat with a bottom portion configured to contact the bottom plate and an upper portion configured to contact the top plate;

a first biasing element configured to urge the valve seat upward away from the bottom plate;

a plunger configured to seat within the upper portion of the valve seat creating a seal there between; and a second biasing element configured to urge the plunger upward away from the valve seat;

wherein upward movement of the pump rod and attached top plate allows oil to flow into an interior portion of the pump mechanism in fluid communication with the oil return line, and downward movement of the pump rod and attached top plate causes the plunger to seat within the valve seat, and causes the bottom portion of the valve seat to seal against the bottom plate such that oil flows into the oil return line and up towards the oil-filled pinion box.

2. The oil pumping system of claim 1, wherein the first and second biasing elements comprise first and second springs, respectively.

3. The oil pumping system of claim 2, wherein the bottom portion of the valve seat is cylindrical, and the upper portion of the valve seat is annular.

4. The oil pumping system of claim 3, wherein the upper portion has a rim that seats against a top end of the first spring.

5. The oil pumping system of claim 1, wherein the oil return line includes a check valve that only allows the oil to flow upward to the oil-filled pinion box.

6. The oil pumping system of claim 1, wherein the oil return line includes a filter to filter out solid contaminants from the oil.

* * * * *